US007090072B1

(12) United States Patent
Elliott

(10) Patent No.: US 7,090,072 B1
(45) Date of Patent: Aug. 15, 2006

(54) DIVIDED PAINT STORAGE APPARATUS

(75) Inventor: Ronald C. Elliott, Monterey, CA (US)

(73) Assignee: Excelligence Learning Corporation, Monterey, CA (US)

( * ) Notice: Subject to any disclaimer, the term of this patent is extended or adjusted under 35 U.S.C. 154(b) by 0 days.

(21) Appl. No.: 10/631,950

(22) Filed: Jul. 30, 2003

(51) Int. Cl.
*B65D 39/14* (2006.01)
*B65D 25/20* (2006.01)
*B65D 43/26* (2006.01)
*A45D 44/18* (2006.01)

(52) U.S. Cl. ..... 206/15.3; 206/362; 220/526; 220/553; 220/736

(58) Field of Classification Search ..... 206/81, 206/1.7, 1.8, 15.2, 15.3, 362; 220/23.4, 23.8, 220/523–524, 526, 532–533, 552, 553, 570, 220/736
See application file for complete search history.

(56) References Cited

U.S. PATENT DOCUMENTS 311,415 A * 1/1885 Cleveland ..... 220/525
402,679 A * 5/1889 Leggett ..... 206/15.3
1,157,475 A * 10/1915 Webster ..... 220/553
2,016,488 A * 10/1935 Eckhaus ..... 220/553
2,826,338 A * 3/1958 Davis ..... 220/524
3,262,556 A * 7/1966 Morrison ..... 206/15.3
4,139,114 A * 2/1979 Long et al. ..... 220/23.4
4,277,000 A * 7/1981 Jaarsma ..... 220/524
4,533,044 A * 8/1985 Ban ..... 206/362
5,490,608 A * 2/1996 Hawkins ..... 220/524
5,746,346 A * 5/1998 Crilly ..... 220/736
5,791,534 A * 8/1998 Davis et al. ..... 224/148.7
6,041,919 A * 3/2000 Adams ..... 206/15.3
6,138,963 A * 10/2000 Malvasio ..... 220/736

* cited by examiner

*Primary Examiner*—Bryon Gehman
(74) *Attorney, Agent, or Firm*—Haverstock & Owens LLP

(57) ABSTRACT

A paint storage apparatus comprising a cap, a container divided into a plurality of chambers, and a lid having a plurality of orifices is disclosed. The apparatus is preferably substantially cylindrical and is uniformly formed from a homogenous material. When the lid is fixed on the container, the orifices are aligned over the chambers, with one of the plurality of orifices over each of the plurality of chambers. Further, when the lid and the container are mated, the plurality of chambers in the container are sealed such that paint cannot be interchanged between the chambers. The cap is configured to detachably couple to the lid and prevent spillage and spoilage of paint stored within the container. In addition, the cap and the lid preferably each further comprise tabs configured to facilitate removal of the lid from the container and to facilitate removal of the cap from the lid.

52 Claims, 7 Drawing Sheets

DIVIDED PAINT STORAGE APPARATUS

FIELD OF THE INVENTION

The present invention relates to the field of paint storage containers. More particularly, this invention relates to a paint storage apparatus that is divided into separate chambers and comprises a complimentary lid with multiple tapered holes aligned with the separate chambers allowing storage of paint in the separate chambers.

BACKGROUND OF THE INVENTION

Paint storage containers such as paint cups are well known and have been used by painters for many years. Painters use paint cups by dipping their paintbrushes into the cups, and then applying the paint from the cups to an accompanying surface. A painter may use a paint cup by itself, or in conjunction with other paint cups, which normally contain other paint colors. Paint cups may be placed near a painter's surface, such as on or near a painter's easel, for easy access and use by the painter.

Paint cups may be made of a variety of materials, including plastic. Paint cups also may exist in various sizes, depending on the amount of paint that the painter needs to utilize, and various shapes such as cylindrical or square. For example, cylindrical/rounded cups are used for ease of fit into easels and cup holders.

Currently, paint cups contain a single chamber space designed to hold only one color of paint. In other words, current paint cups are unable to separately hold more than one color of paint at the same time. This has many disadvantages: multiple cups are required by a painter who is using more than one color or type of paint; and more space is required at or near a paint easel for storing multiple paint cups. Further, current paint cup lids contain only one hole through which the painter may dip his/her paintbrush.

SUMMARY OF THE INVENTION

A divided paint storage apparatus is disclosed. The preferred apparatus comprises a container, a lid, and a cap. The container comprises integrally formed walls defining a main chamber body portion with an open upper end. The container is divided into a plurality of chambers. It should be understood that the terms compartments, cavities, chambers, or chamber regions are used interchangeably. One or more inner walls divide the main chamber of the container into the plurality of chambers. The plurality of chambers are preferably defined by the enclosed space between the one or more inner walls and the main chamber and are configured for receiving and retaining paint in separate and sealed chambers.

The lid of the current invention preferably matches the container and comprises a planar surface with a top, a bottom, and a plurality of orifices. The bottom of the planar surface preferably comprises one or more depending grooves configured to cooperatively engage with the one or more inner walls and align the plurality of orifices over the plurality of chambers, with one of the plurality of orifices over each of the plurality of chambers.

In one embodiment, this may be achieved by using a guiding means on the lid that is configured to mate with the container. Further, the guiding means is also affixed to the container in a manner that ensures that the plurality of orifices in the lid are equally aligned over the respective chambers of the container.

In alternate embodiments, the lid and container are in a shape which does not require use of depending grooves or a guiding means to ensure alignment of the plurality of orifices with the plurality of chambers. For example, a square shaped lid and matching container ensure an aligned and securely divided paint storage apparatus configuration.

In yet another embodiment, one or more guiding means couple with one or more inner walls through an annular locking structure that frictionally engages so as to create a positive seal. Alternately, the guiding means may comprise a channel configured to couple with a raised inner wall of the container so as to create a positive seal between the lid and the container.

Regardless of the means used to mate the lid and the container, when the lid and the container are mated, the plurality of chambers in the container are sealed such that the paint cannot be interchanged between the chambers. Further, regardless of the shape of the container or lid, the plurality of orifices preferably are in a tapered configuration. This allows paintbrushes to be guided into each separate chamber and also provides the user with a surface to rub off excess paint from the paint brush.

In the preferred embodiment, the apparatus further comprises a cap configured to detachably couple to the lid and prevent spillage and spoilage of paint stored within the container. The cap preferably provides an air tight seal when coupled to the lid to prevent the spillage and spoilage of paint stored in the cup. In addition, the lid and cap preferably each further comprise tabs configured to facilitate removal of the lid from the container. Alternatively, the lid is coupled to the cap by a hinge.

The container is preferably substantially cylindrical and is uniformly formed from a homogenous material. The homogenous material preferably comprises a polymer resin, however, the homogenous material may also comprise polypropylene or a liquid impervious plastic material in alternate embodiments. In alternate embodiments, the shape of the container and matching lid and cap may include, but are not limited to, circular, square, triangular, angular, or star shaped. In the preferred container, the container is further configured such that the diameter of the top of the container is greater than the maximum diameter of the bottom of the container. In alternate embodiments, the bottom of the divided paint storage apparatus further comprises an annular ring configured to support the apparatus on a surface.

In addition to the embodiments disclosed above, a method of forming a divided paint cup is disclosed. Specifically, the method comprises first thermoforming plastic into one or more dividing walls with a generally parallel matrix configured into a generally cylindrical shape. Next, plastic is thermoformed around the dividing walls and into a generally cylindrical body portion. The body portion has an open upper end and a rim extending radially outwardly from the perimeter of the open end of the body portion. The method disclosed may further comprise the step of thermoforming plastic into a generally cylindrical lid having a plurality of orifices and a plurality of grooves configured to mate with the plurality of dividing walls.

In short, the divided paint storage apparatus is preferably a round cylinder made of clear plastic and is configured to hold paint in separate chambers. These chambers are preferably, but not necessarily, equal in size. These different paint chambers, and paints contained therein, are easily accessible for use by a painter. The separate and sealed chambers are defined by interior walls of the apparatus and prevent any interchange between the paints from each separate chamber.

DETAILED DESCRIPTION OF THE INVENTION

Figure 1A:
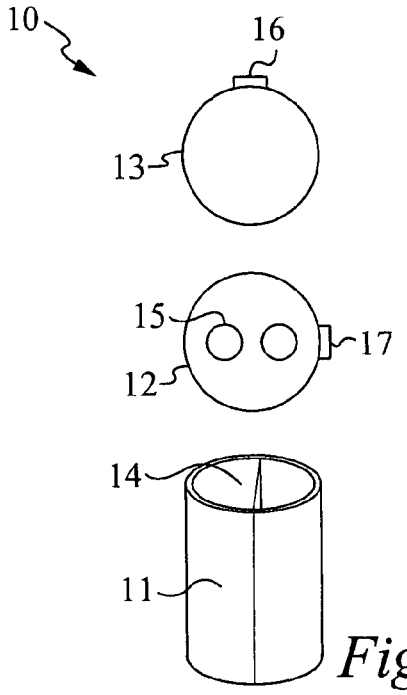
FIGS. 1A and 1B illustrate top views of divided paint storage apparatus caps and lids, and isometric views of divided paint storage apparatus containers in a substantially cylindrically shaped configuration, in accordance with the instant invention.
Figure 1B:
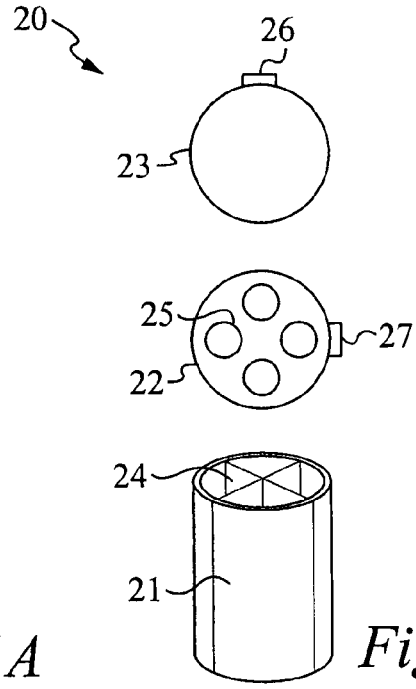
Figure 1C:
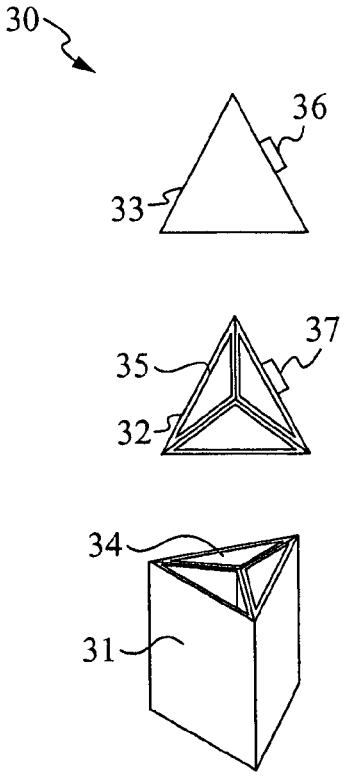
FIG. 1C illustrates the top view of a divided paint storage apparatus cap and lid, and an isometric view of the divided paint storage apparatus container in a substantially triangularly shaped configuration, in accordance with the instant invention.
Figure 1D:
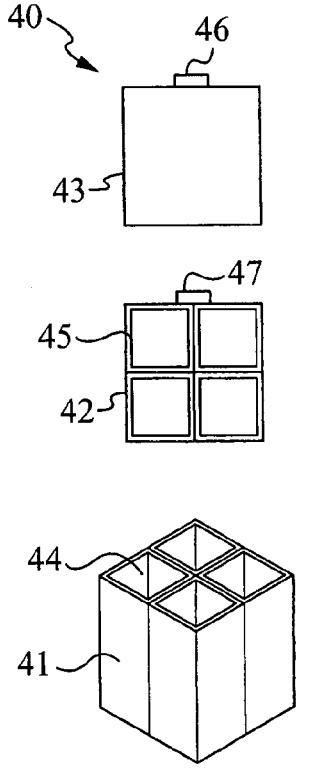
FIG. 1D illustrates the top view of a divided paint storage apparatus cap and lid, and an isometric view of the divided paint storage apparatus container in a substantially square shaped configuration, in accordance with the instant invention.
Figure 1E:
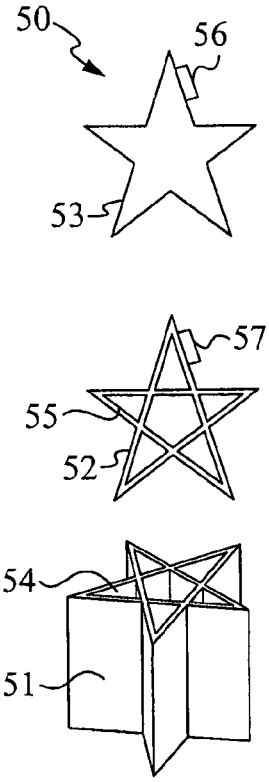
FIG. 1E illustrates the top view of a divided paint storage apparatus cap and lid, and an isometric view of the divided paint storage apparatus container in a substantially star shaped configuration, in accordance with the instant invention.

FIGS. 1A–1E illustrate the various embodiments of the divided paint storage containers currently disclosed. FIGS. 1A and 1B illustrate embodiments of the divided paint storage apparatus in a substantially cylindrically shaped configuration. FIG. 1C illustrates an embodiment in which the divided paint storage apparatus is in a substantially triangularly shaped configuration. FIG. 1D illustrates yet another embodiment in which the divided paint storage apparatus is in a substantially square shaped configuration, while FIG. 1E illustrates a divided paint storage apparatus container in a substantially star shaped configuration. The paint container of the preferred embodiment is substantially cylindrically shaped and has two chambers as illustrated in FIG. 1A.

Specifically, the simplified apparatus 10 illustrated in FIG. 1A comprises a container 11, a lid 12, and a cap 13 configured in a substantially cylindrical shape. The container 11 is divided into two chamber regions 14. The lid 12 matches the shape of, and mates with, the container 11. The lid 12 also comprises a plurality of orifices 15. Similarly, the cap 13 matches the shape of, and mates with, the lid 12. The cap 13 and the lid 12 each further comprise a tab 16 and a tab 17, respectively. The tab 16 and tab 17 allow for easier removal of the lid 12 and the cap 13 from other components of the apparatus 10.

The simplified apparatus 20 illustrated in FIG. 1B comprises a container 21, a lid 22, and a cap 23 configured in a substantially cylindrical shape. The container 21 is divided into four chamber regions 24. The lid 22 matches the shape of, and mates with, the container 21. The lid 22 also comprises a plurality of orifices 25. Similarly, the cap 23 matches the shape of, and mates with, the lid 22. The cap 23 and the lid 22 each further comprise a tab 26 and a tab 27, respectively. The tab 26 and tab 27 allow for easier removal of the lid 22 and the cap 23 from other components of the apparatus 20.

The simplified apparatus 30 illustrated in FIG. 1C comprises a container 31, a lid 32, and a cap 33 configured in a substantially triangular shape. The container 31 is divided into three chamber regions 34. The lid 32 matches the shape of, and mates with, the container 31. The lid 32 also comprises a plurality of orifices 35. Similarly, the cap 33 matches the shape of, and mates with, the lid 32. The cap 33 and the lid 32 each further comprise a tab 36 and a tab 37, respectively. The tab 36 and tab 37 allow for easier removal of the lid 32 and the cap 33 from other components of the apparatus 30.

The simplified apparatus 40 illustrated in FIG. 1D comprises a container 41, a lid 42, and a cap 43 configured in a substantially square shape. The container 41 is divided into four chamber regions 44. The lid 42 matches the shape of, and mates with, the container 41. The lid 42 also comprises a plurality of orifices 45. Similarly, the cap 43 matches the shape of, and mates with, the lid 42. The cap 43 and the lid 42 each further comprise a tab 46 and a tab 47, respectively. The tab 46 and tab 47 allow for easier removal of the lid 42 and the cap 43 from other components of the apparatus 40.

The simplified apparatus 50 illustrated in FIG. 1E comprises a container 51, a lid 52, and a cap 53 configured in a substantially star shape. The container 51 is divided into six chamber regions 54. The lid 52 matches the shape of, and mates with, the container 51. The lid 52 also comprises a plurality of orifices 55. Similarly, the cap 53 matches the shape of, and mates with, the lid 52. The cap 53 and the lid 52 each further comprise a tab 56 and a tab 57, respectively. The tab 56 and tab 57 allow for easier removal of the lid 52 and the cap 53 from other components of the apparatus 50.

Figure 2A:
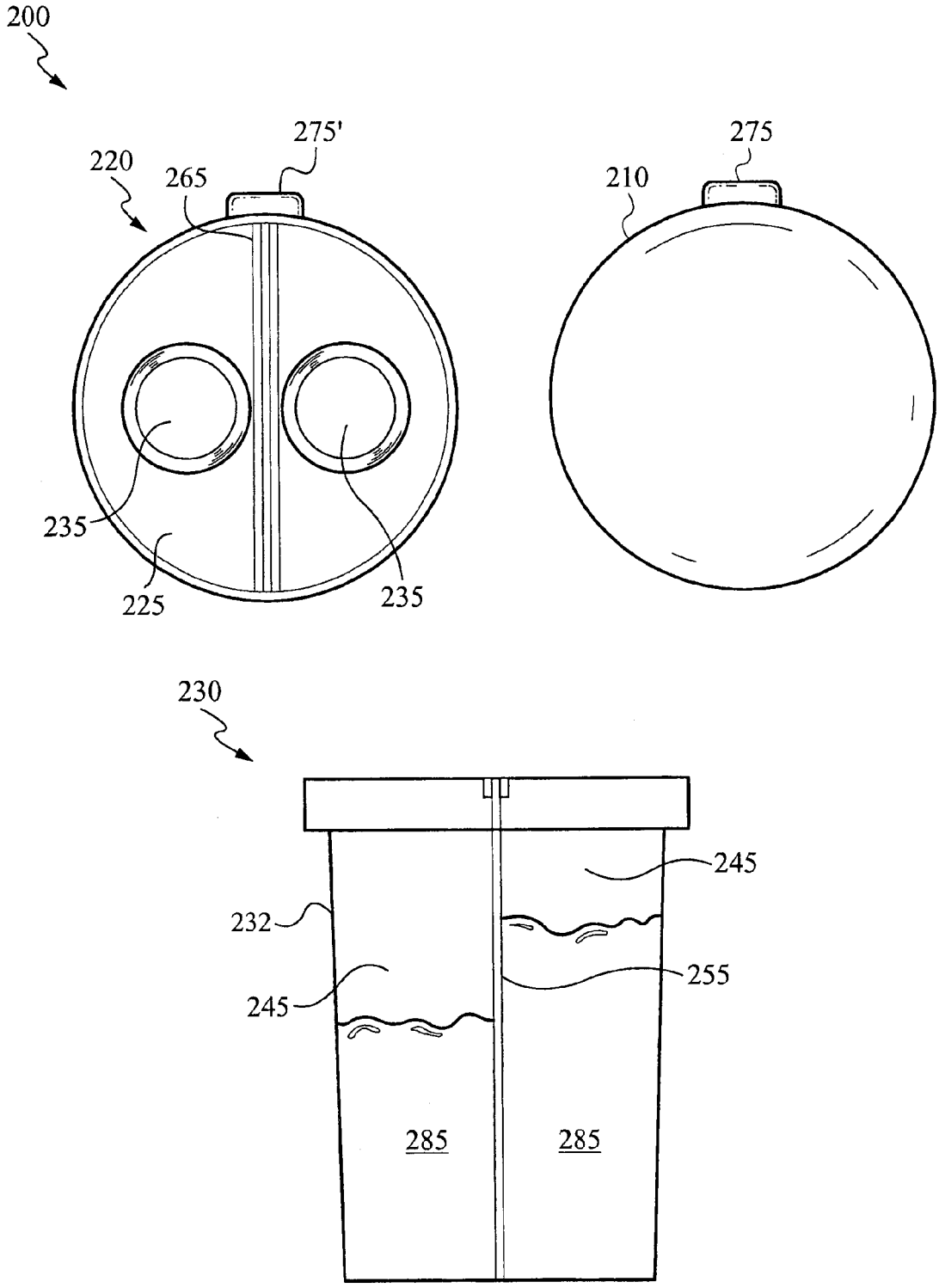
FIG. 2A illustrates the top view of a divided paint storage apparatus cap and lid, and a side view of the divided paint storage apparatus container in a substantially cylindrically shaped configuration, in accordance with the instant invention.

FIG. 2A illustrates a divided paint storage apparatus 200. The apparatus 200 comprises a cap 210, a lid 220, and a container 230. The container 230 is in a substantially cylindrically shaped configuration.

Specifically, the container 230 of the apparatus 200 comprises integrally formed walls which define a body portion main chamber 232 with an open upper end. The container 230 is divided into a plurality of cavities 245. Inner walls 255 divide the main chamber 232 of the container 230 into the plurality of cavities 245. The plurality of cavities 245 are preferably defined by the enclosed space between the inner walls 255 and the main chamber 232 and are configured for receiving and retaining paint in the separate and sealed chambers of the plurality of cavities 245.

The lid 220 of the current invention preferably matches the container 230 and comprises a planar surface with a top (not shown), a bottom 225, and a plurality of orifices 235. The bottom 225 of the lid 220 preferably comprises a depending groove 265 configured to cooperatively engage with the inner walls 255 of the container 230 and align the plurality of orifices 235 over the plurality of cavities 245, with one of the plurality of orifices 235 over each of the plurality of cavities 245. In other words, when the lid 220 and the container 230 are mated, the plurality of cavities 245 in the container 230 are sealed such that paint 265 cannot be interchanged between the cavities 245.

In one embodiment, the lid 220 is coupled with the container 230 via a guiding means (not shown) on the lid 220 that is configured to mate with the container 230. Similar to the depending groove 265 coupling with the inner walls 255, the guiding means (not shown) also affixes to the container 230 in a manner that ensures that the plurality of orifices 235 in the lid 220 are equally aligned over the respective plurality of cavities 245 of the container 230.

In yet another embodiment, a plurality of depending grooves (similar to the depending grooves 245) couple with multiple inner walls (similar to the inner walls 255) through an annular locking structure (not shown) that frictionally engages so as to create a positive seal.

Regardless of the means used to mate the lid and the container, when the lid and the container are mated, the plurality of chambers in the container are sealed such that the paint cannot be interchanged between the chambers. Further, regardless of the shape of the container or lid, the plurality of orifices preferably are in a tapered configuration. This allows paintbrushes to be guided into each separate compartment and also provides the user with a surface to rub off excess paint from the paint brush.

In the preferred embodiment, the apparatus further comprises a cap 210 configured to detachably couple to the lid 220 and prevent spillage and spoilage of paint 285 stored within the container 230. The cap 210 preferably provides an airtight seal when coupled to the lid 220 to prevent the spillage and spoilage of paint stored in the paint cup. This allows the user to retain the paint within the paint cup without pouring the paint back into the original container, which could contaminate the rest of the paint by introducing bacteria from the painting process. In addition, the cap 210 and the lid 220 preferably each further comprise tabs 275 and 275', respectively, configured to facilitate removal of the lid 220 from the container 230 and to facilitate removal of the cap 210 from the lid 220. Alternatively, the lid is coupled to the cap by a hinge.

The container is preferably substantially cylindrical and is uniformly formed from a homogenous material. The homogenous material preferably comprises a polymer resin, however, the homogenous material may also comprise polypropylene or a liquid impervious plastic material in alternate embodiments. In alternate embodiments, as shown in FIGS. 1A–E, the shape of the container and matching lid may include, but are not limited to, circular, square, triangular, or star shaped and include any appropriate number of separate paint compartments. In the preferred substantially cylindrically shaped container, the container is further configured such that the diameter of the top of the container is greater than the maximum diameter of the bottom of the container. In alternate embodiments, the bottom of the divided paint storage apparatus further comprises an annular ring configured to support the apparatus on a surface.

Figure 2B:
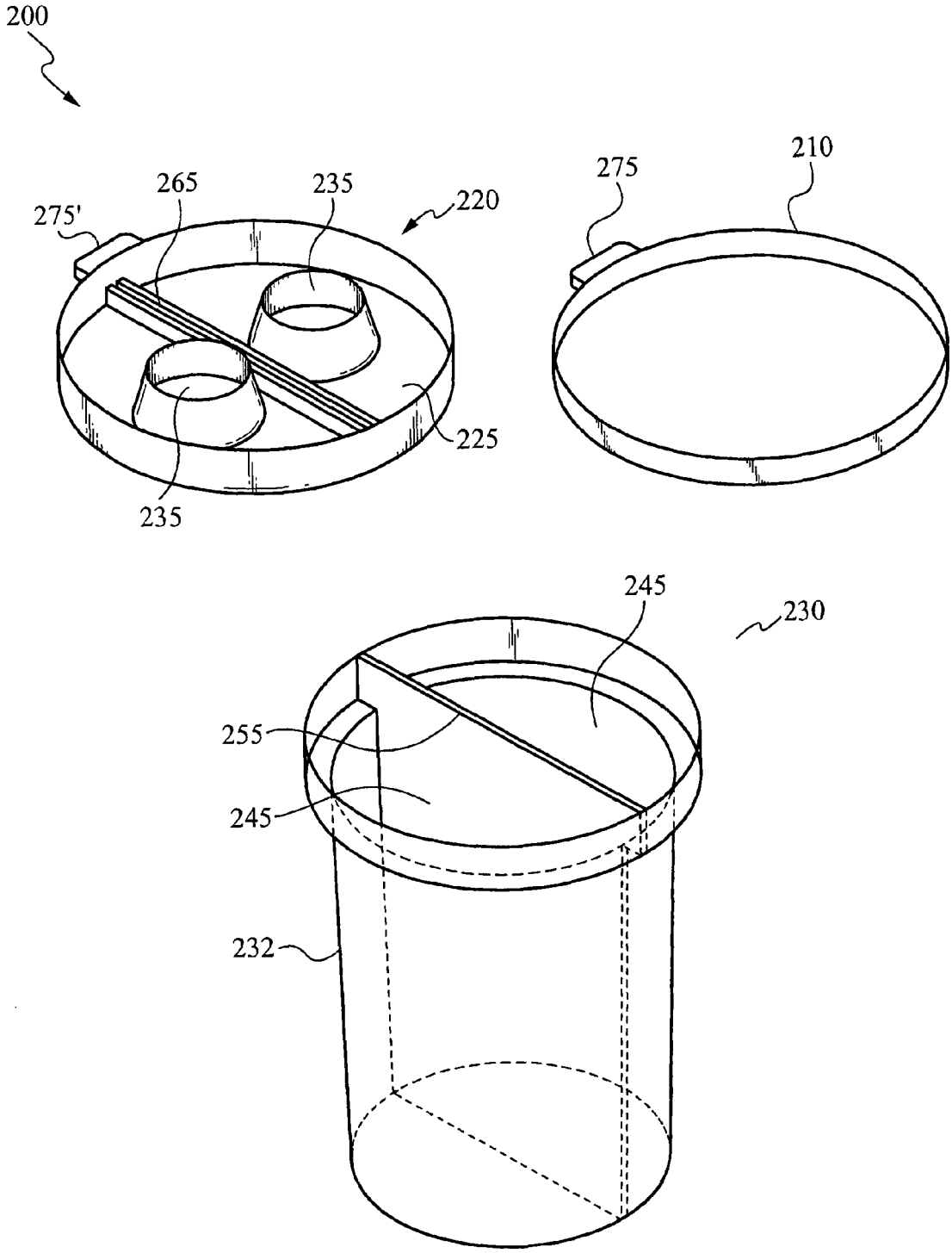
FIG. 2B illustrates an isometric view of the divided paint storage apparatus cap, lid, and container of FIG. 2A, in accordance with the instant invention.
Figure 2C:
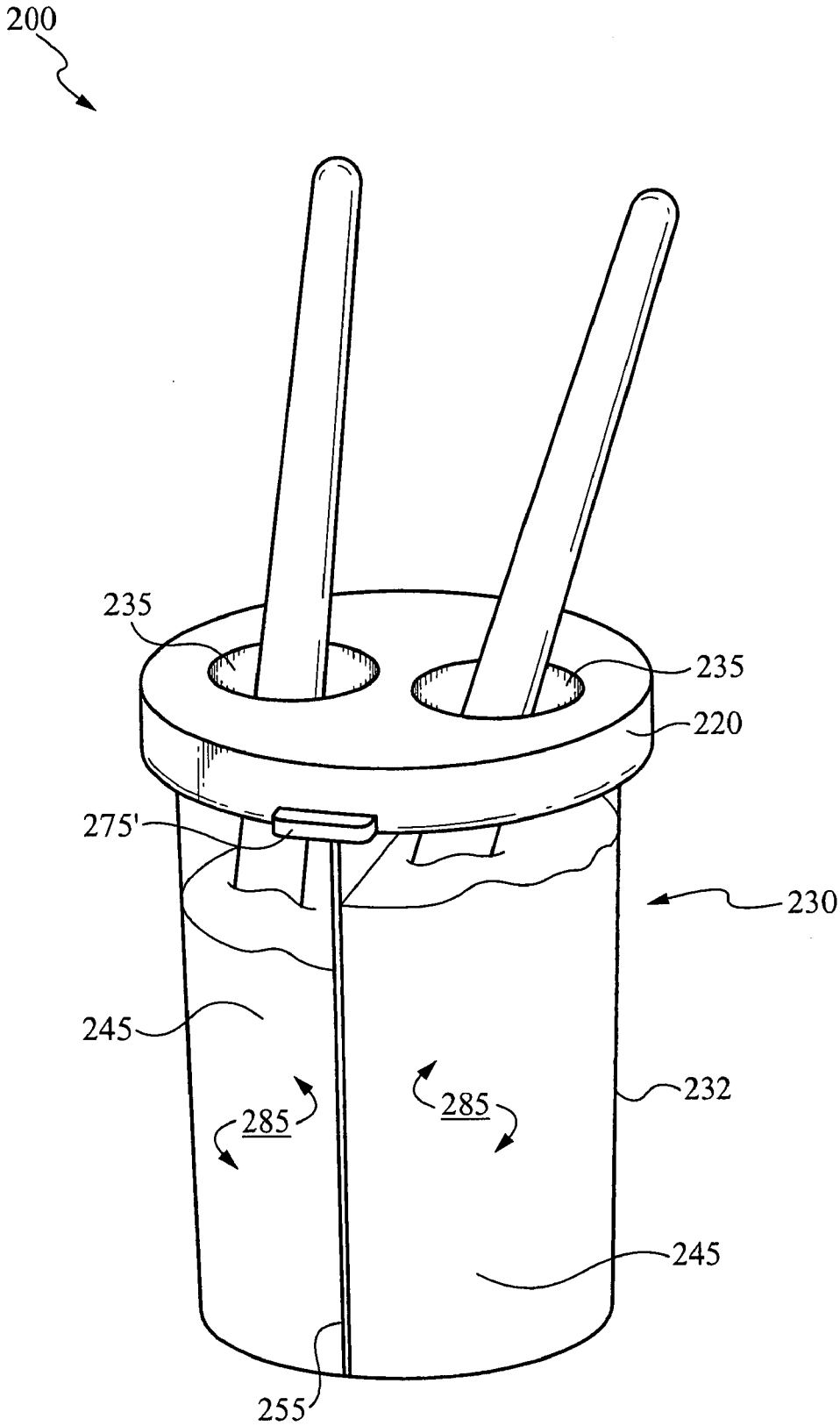
FIG. 2C illustrates an isometric view of the divided paint storage apparatus of FIG. 2A with the lid mated with the container, in accordance with the instant invention.

FIGS. 2B and 2C illustrate the divided paint storage apparatus of FIG. 2A (as described in detail above) in an isometric view. Specifically, FIG. 2B illustrates an isometric view of the divided paint storage apparatus cap, lid, and container of FIG. 2A. FIG. 2C illustrates an isometric view of the divided paint storage apparatus of FIG. 2A, with the lid mated with the container.

Figure 3A:
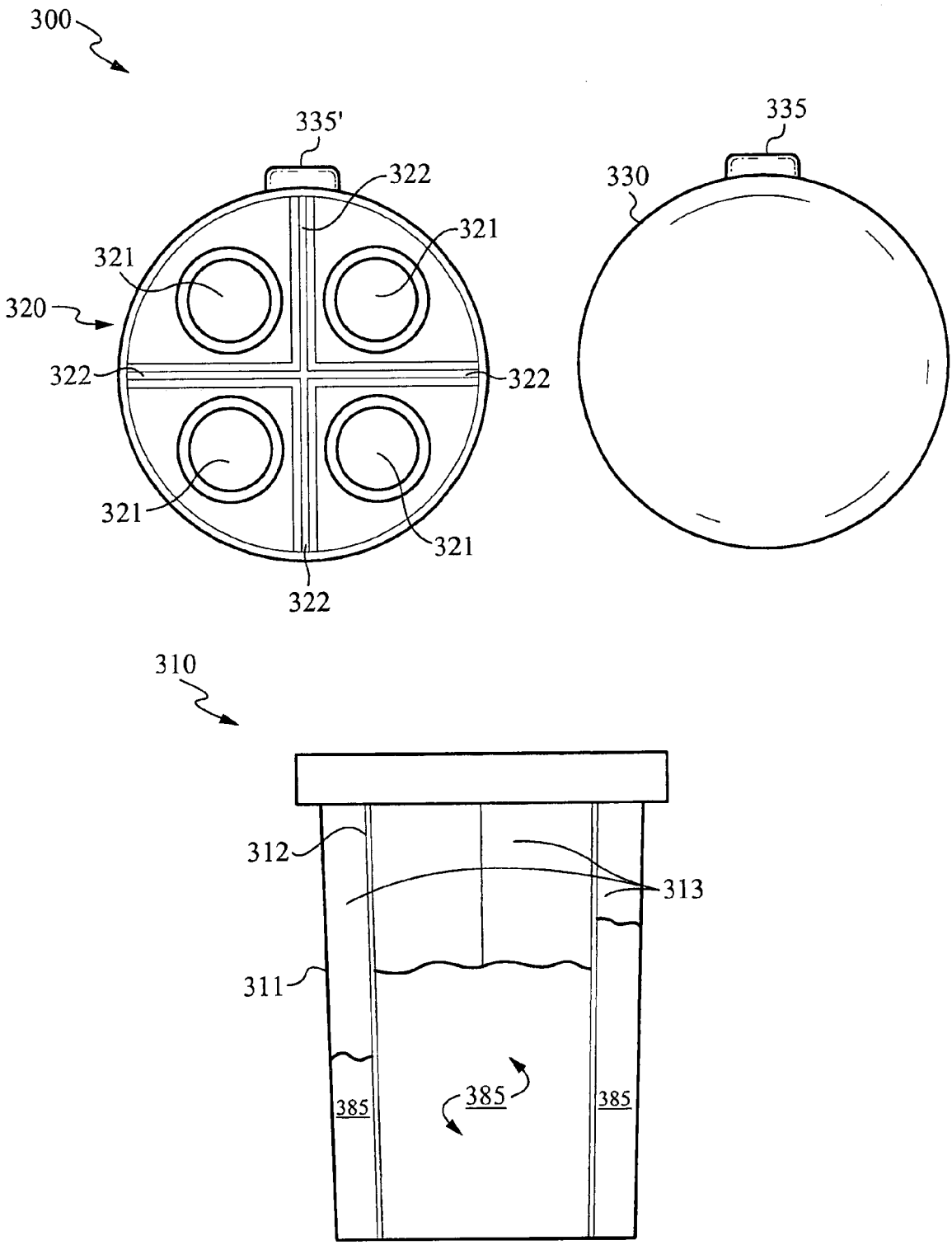
FIG. 3A illustrates the top view of a divided paint storage apparatus cap and lid, and a side view of the divided paint storage apparatus container in an alternate embodiment of a substantially cylindrically shaped configuration, in accordance with the instant invention.

FIG. 3A illustrates the top view of a divided paint storage apparatus cap and lid, and a side view of divided paint storage apparatus container in an alternate embodiment of a substantially cylindrically shaped configuration. Specifically, an alternate embodiment of a divided paint storage apparatus 300 is disclosed. The apparatus 300 comprises a cup 310, a lid 320, and a cap 330. The cup 310 comprises integrally formed interior walls 311. The cup 310 further comprises a plurality of dividers 312 coupled to the interior walls 311 and configured to separate the cup 310 into a plurality of separate chambers 313 configured to store paint (not shown). The lid 320 comprises a plurality of orifices 321 configured to align with the plurality of separate chambers 313. The lid 320 further comprises a plurality of guiding means 322 configured to couple with the plurality of dividers 312. This allows the lid 320 to couple with the cup 310 by frictionally engaging so as to create a positive seal. In alternate embodiments, the lid 320 couples to the cup 310 through an annular locking structure (not shown) that frictionally engages so as to create a positive seal. In yet another embodiment, the plurality of guiding means 322, or similar groove means (not shown), are cooperatively engaged with the plurality of dividers 312, or other similar plurality of inner walls (not shown). Regardless of the means in which the lid 320 couples with the cup 310, the plurality of guiding means 322 are configured to align the plurality of orifices 321 with the plurality of separate chambers 313. Further, the orifices 321 are in a tapered configuration (as shown).

The apparatus 300 further comprises a cap 330 configured to detachably couple to the lid 320 and prevent spillage and spoilage of paint 385 stored within the plurality of separate chambers 313. The cap 330 further comprises a tab 335 configured to facilitate removal of the cap 330 from the lid 320. The lid 320 also comprises a tab 335' configured to facilitate removal of the lid 320 from the cup 310 of the apparatus 300.

Figure 3B:
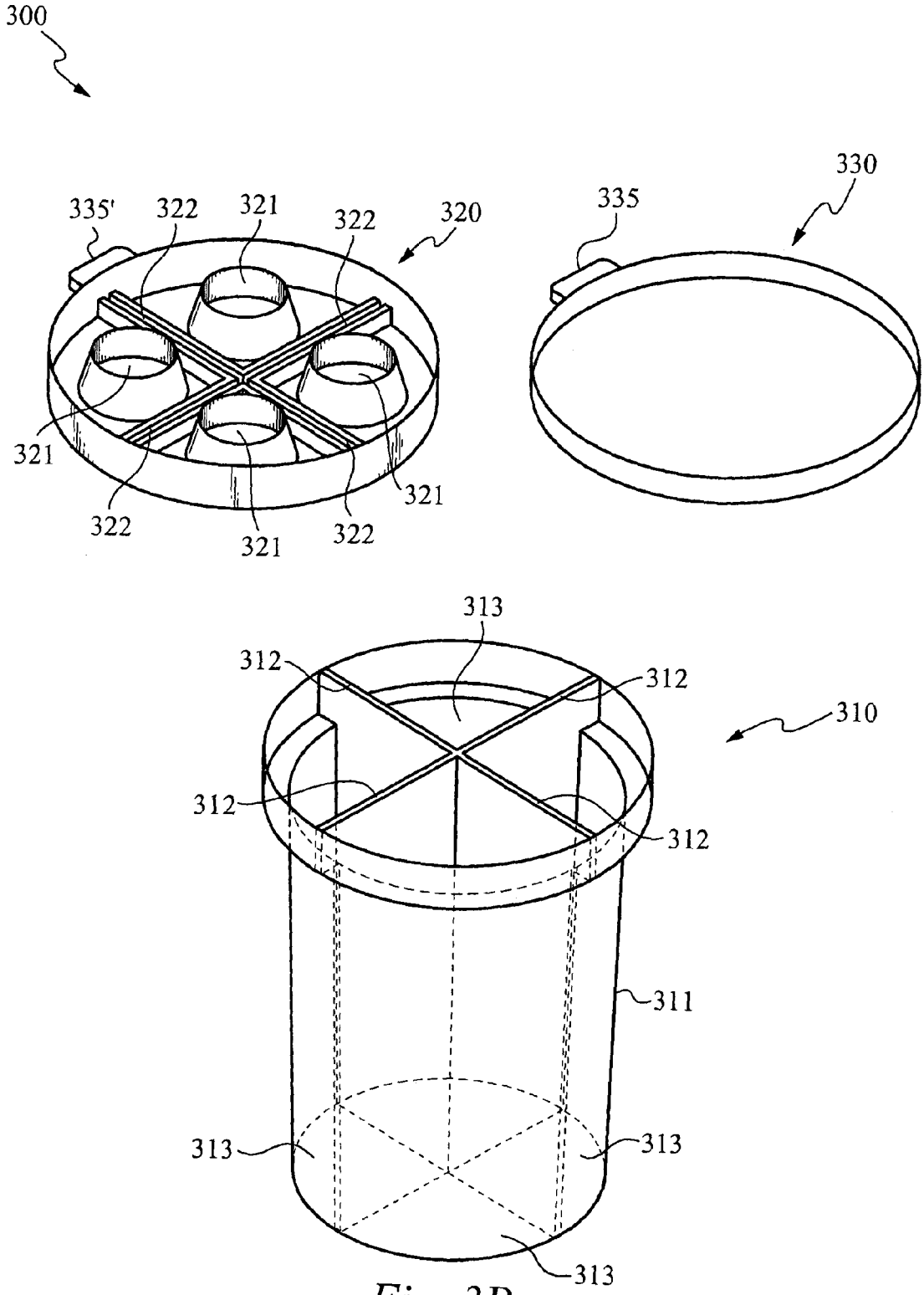
FIG. 3B illustrates an isometric view of the divided paint storage apparatus cap, lid, and container of FIG. 3A, in accordance with the instant invention.
Figure 3C:
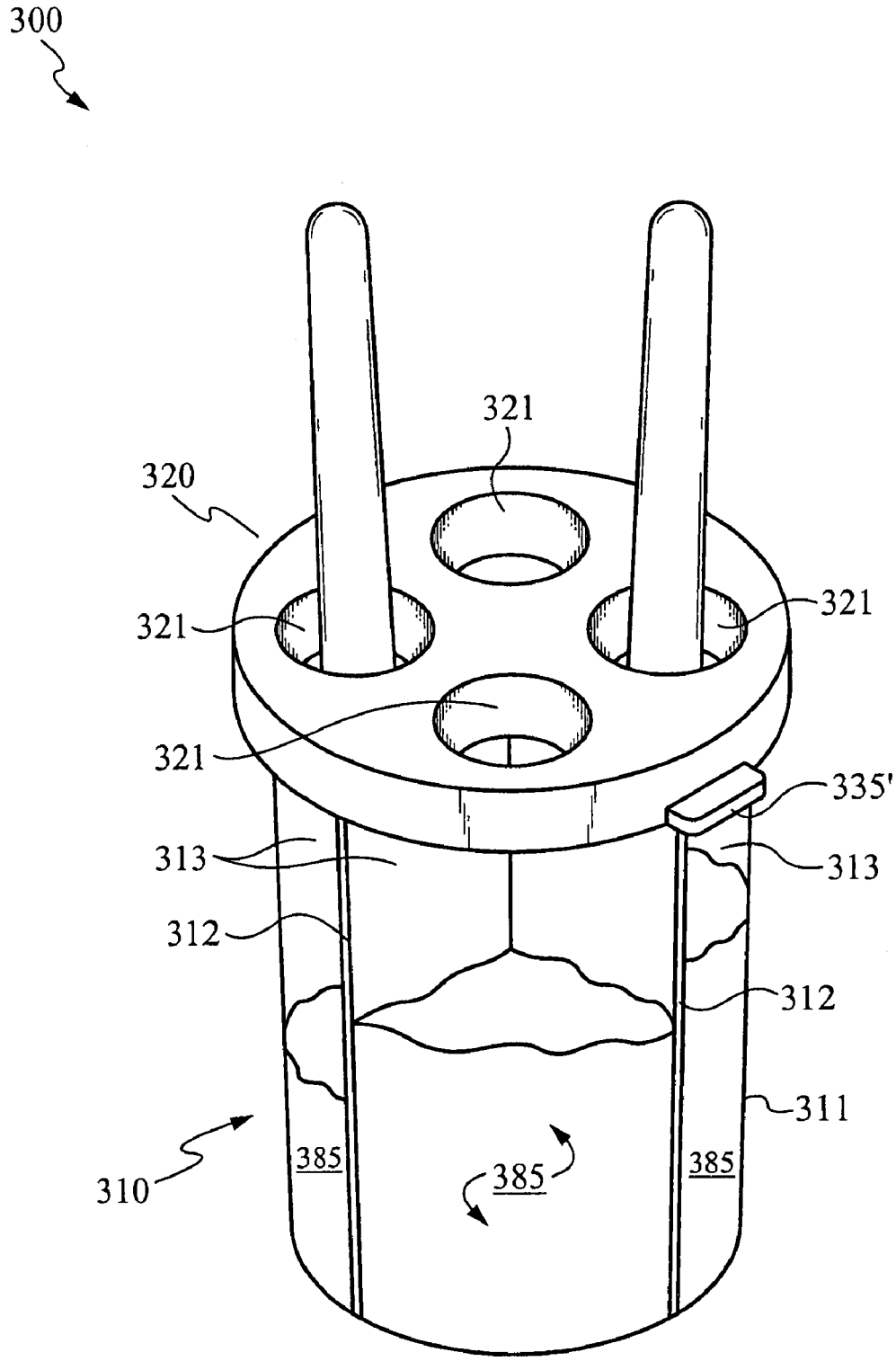
FIG. 3C illustrates an isometric view of the divided paint storage apparatus of FIG. 3A with the lid mated with the container, in accordance with the instant invention.

The cup 310 of the apparatus 300 shown in FIGS. 3A–3C is in a substantially circular shape. In alternate embodiments, the cup 310 may be annular in shape (not shown). The shape of the cup 310 is configured such that the diameter of the top of the cup 310 is greater than the maximum diameter of the bottom of the cup 310. In alternate embodiments, the bottom of the cup 310 further comprises an annular ring (not shown) configured to support the apparatus on a surface.

Further, the apparatus 300 is uniformly formed from a homogenous material. In one embodiment, the homogenous material comprises a polymer resin, however, the homogenous material may also comprise polypropylene or a liquid impervious plastic material in alternate embodiments.

FIGS. 3B and 3C illustrate the divided paint storage apparatus of FIG. 3A (as described in detail above) in an isometric view. Specifically, FIG. 3B illustrates an isometric view of the divided paint storage apparatus cap, lid, and container of FIG. 3A. FIG. 3C illustrates an isometric view of the divided paint storage apparatus of FIG. 3A with the lid mated with the container.

In addition to the embodiments disclosed above, a method of forming a divided paint cup is disclosed. Specifically, the method comprises first thermoforming plastic into one or more dividing walls with a generally parallel matrix configured into a generally cylindrical shape. Next, plastic is thermoformed around the dividing walls and into a generally cylindrical body portion having an open upper end, a rim extending radially outwardly from the perimeter of the open end of said body portion. The method disclosed may further comprise the step of thermoforming plastic into a generally cylindrical lid having a plurality of orifices and a plurality of grooves configured to mate with the plurality of dividing walls.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

Specifically, it will be apparent to one of ordinary skill in the art that the device of the present invention could be implemented in several different ways and the embodiments disclosed above are only exemplary of the preferred embodiment and the alternate embodiments of the invention and is in no way a limitation. For example, the round cylinder can be substituted by a square cylinder. Or, the lid may comprise an annular base portion and a annular wall, where the annular wall is joined to the annular base portion. Further, the lid may comprise a plurality of groove means coupled to the annular base portion. In yet another example, a main chamber of the apparatus is formed by a substantially vertical sidewall portion and two arcuate portions, with the arcuate portions blending into the sidewall portion. In short, the divided paint storage apparatus is preferably a round cylinder made of clear plastic and is configured to hold paint in separate chambers. These chambers are preferably, but not necessarily, equal in size. The separate and sealed chambers are defined by interior walls of the apparatus and prevent any interchange between the paints from each separate chamber. These different paint chambers, and paints contained therein, are easily accessible for use by a painter.

What is claimed is:

1. A paint storage apparatus comprising:

a. a container divided into a plurality of adjoining paint storage compartments by one or more walls; and b. a removable lid having a plurality of orifices and one or more depending grooves, wherein when the removable lid is fixed on the container the depending grooves cooperatively engage with the one or more walls aligning the orifices over the compartments, with one of the plurality of orifices over each of the plurality of compartments.

2. The apparatus of claim 1, wherein the container and the removable lid are substantially cylindrical.

3. The apparatus of claim 1, wherein the container and the removable lid are substantially circular.

4. The apparatus of claim 1, wherein the container and the removable lid are substantially square.

5. The apparatus of claim 1, wherein the container and the removable lid are substantially angular.

6. A paint storage container comprising:

a. a body portion having an open upper end and forming a chamber region;

b. one or more walls dividing the chamber region into a plurality of adjoining paint storage compartments; and c. a removable lid having a plurality of orifices configured to align over the paint storage compartments, wherein one of the plurality of orifices is over each of the plurality of compartments, and wherein the removable lid is configured to mate with the one or more walls so as to create a positive seal, and further wherein the lid further comprises one or more grooves configured to cooperatively engage the lid with the body portion.

7. The container of claim 6, wherein the container is substantially cylindrical.

8. The container of claim 6, wherein the container is substantially circular.

9. The container of claim 8, wherein a diameter of the open end is greater than a maximum diameter of the bottom of the container.

10. The container of claim 6, wherein the container is substantially square.

11. The container of claim 6, wherein the container is substantially angular.

12. The container of claim 6, wherein the container is uniformly formed from a homogenous material.

13. The container of claim 6, wherein the removable lid further comprises a tab configured to facilitate removal of the lid from the container.

14. The container of claim 6, wherein the container further comprises a cap, configured to detachably couple to the removable lid and prevent spillage and spoilage of paint stored within the container.

15. A divided paint storage apparatus comprising:

a. a cup comprising:

i. integrally formed interior walls; and ii. one or more dividers coupled to the interior walls and configured to separate the cup into a plurality of adjoining chambers configured to store paint; and b. a removable lid comprising:

i. one or more orifices configured to align with the plurality of adjoining chambers; and ii. one or more guiding means configured to couple with the one or more dividers and to align the one or more orifices with the plurality of adjoining chambers.

16. The divided paint storage apparatus of claim 15, wherein a shape of the cup is substantially cylindrical.

17. The divided paint storage apparatus of claim 15, wherein a shape of the cup is substantially circular.

18. The divided paint storage apparatus of claim 17, wherein the shape of the cup is configured such that a diameter of the top of the cup is greater than a maximum diameter of the bottom of the cup.

19. The divided paint storage apparatus of claim 15, wherein a shape of the cup is substantially square.

20. The divided paint storage apparatus of claim 15, wherein a shape of the cup is substantially angular.

21. The divided paint storage apparatus of claim 15, wherein the lid couples to the cup through an annular locking structure that frictionally engages so as to create a positive seal.

22. The divided paint storage apparatus of claim 15, wherein the one or more guiding means couple with the one or more dividers through an annular locking structure that frictionally engages so as to create a positive seal.

23. The divided paint storage apparatus of claim 15, wherein the apparatus is uniformly formed from a homogenous material.

24. The divided paint storage apparatus of claim 23, wherein the homogenous material comprises a polymer resin.

25. The divided paint storage apparatus of claim 23, wherein the homogenous material comprises polypropylene.

26. The divided paint storage apparatus of claim 23, wherein the homogenous material comprises a liquid impervious plastic material.

27. The divided paint storage apparatus of claim 15, wherein the orifices are in a tapered configuration.

28. The divided paint storage apparatus of claim 15, wherein the apparatus further comprises a cap configured to detachably couple to the lid and prevent spillage and spoilage of paint stored within the plurality of adjoining chambers.

29. The divided paint storage apparatus of claim 28, wherein the cap further comprises a tab configured to facilitate removal of the cap from the apparatus.

30. The divided paint storage apparatus of claim 15, wherein the lid further comprises a tab configured to facilitate removal of the lid from the apparatus.

31. The divided paint storage apparatus of claim 15, wherein the bottom of the cup further comprises an annular ring configured to support the apparatus on a surface.

32. An annular paint cup comprising:

a. one or more walls contained within the annular paint cup, wherein the one or more walls divide the annular paint cup and define a plurality of paint storage cavities; and b. a removable lid with a plurality of orifices comprising a planar surface with a top and a bottom, wherein the bottom of the planar surface comprises one or more depending grooves configured to cooperatively engage with the one or more walls and align the plurality of orifices with the plurality of paint storage cavities.

33. A divided paint cup comprising;

a. a container means for retaining paint comprising:

i. a main chamber divided by one or more inner walls;

ii. a plurality of storage cavities defined by the enclosed space between the inner walls and the main chamber and configured for receiving and retaining paint;

b. a removable lid comprising:

i. an annular base portion and an annular wall joined to the annular base portion;

ii. a plurality of groove means coupled to the annular base portion and configured to cooperatively engage with the one or more inner walls; and iii. a plurality of orifices configured to align with the plurality of storage cavities when the plurality of groove means are cooperatively engaged with the one or more inner walls.

34. The divided paint cup of claim 33, wherein the main chamber comprises an open top and a bottom and is formed by a substantially vertical portion and two arcuate portions, wherein the arcuate portions blend into the sidewall portion.

35. The divided paint cup of claim 33, wherein the lid and the container means further comprise an annular locking structure configured to frictionally engage so as to create a positive seal.

36. A divided paint storage apparatus comprising;

a. integrally formed interior walls;

b. one or more dividers coupled to the interior walls and configured to separate the apparatus into a plurality of adjoining chambers configured to store paint; and c. a removable lid with a plurality of orifices, wherein the removable lid is configured to removably couple to the integrally formed interior walls through an annular locking structure that frictionally engages so as to create a positive seal and further wherein the removable lid further comprises one or more grooves configured to cooperatively engage the removable lid with the body portion.

37. The divided paint storage apparatus of claim 36, wherein a shape of the divided paint storage apparatus is substantially cylindrical.

38. The divided paint storage apparatus of claim 36, wherein a shape of the divided paint storage apparatus is substantially circular.

39. The divided paint storage apparatus of claim 36, wherein a shape of the divided paint storage apparatus is substantially square.

40. The divided paint storage apparatus of claim 36, wherein a shape of the divided paint storage apparatus is substantially angular.

41. The divided paint storage apparatus of claim 36, wherein the divided paint storage apparatus is uniformly formed from a homogenous material.

42. The divided paint storage apparatus of claim 41, wherein the homogenous material comprises a polymer resin.

43. The divided paint storage apparatus of claim 41, wherein the homogenous material comprises polypropylene.

44. The divided paint storage apparatus of claim 41, wherein the homogenous material comprises a liquid impervious plastic material.

45. The divided paint storage apparatus of claim 36, wherein the orifices are in a tapered configuration.

46. The divided paint storage apparatus of claim 36, wherein the divided paint storage apparatus further comprises a cap configured to detachably couple to the lid and prevent spillage and spoilage of paint stored within the plurality of adjoining chambers.

47. The divided paint storage apparatus of claim 46, wherein the cap further comprises a tab configured to facilitate removal of the cap from the apparatus.

48. The divided paint storage apparatus of claim 36, wherein the divided paint storage apparatus further comprises a cap configured to couple to the lid by a hinge.

49. The divided paint storage apparatus of claim 36, wherein the lid further comprises a tab configured to facilitate removal of the lid from the apparatus.

50. The divided paint storage apparatus of claim 36, wherein the lid further comprises an indentation configured to facilitate removal of the lid from the apparatus.

51. A method of forming a divided paint cup, comprising the steps of:

a. thermoforming plastic into one or more dividing walls configured into a generally cylindrical shape;

b. thermoforming plastic around the dividing walls and into a generally cylindrical body portion having an open upper end, a rim extending radially outwardly from the perimeter of the open end of said body portion; and c. thermoforming plastic into a generally cylindrical removable lid having one or more orifices and one or more grooves configured to cooperatively engage the removable lid with the dividing walls.

52. A paint storage apparatus comprising:

a. a container divided into a plurality of adjoining paint storage compartments by one or more walls; and b. a removable lid having a plurality of orifices and one or more depending grooves, wherein when the removable lid is fixed on the container the depending grooves cooperatively engage with the one or more walls aligning the orifices over the compartments, with one of the plurality of orifices over each of the plurality of compartments, permitting selective insertion of a paint applicator into each of the plurality of compartments.

* * * * *